US005916274A

United States Patent [19]

Lee et al.

[11] Patent Number: 5,916,274

[45] Date of Patent: Jun. 29, 1999

[54] REINFORCED BALL BALANCER FOR CLOTHES WASHING MACHINE

[75] Inventors: Joon Yeop Lee; Do Weon Kim, both of Seoul, Rep. of Korea

[73] Assignee: Samsung Electronics Co., Ltd., Suwon, Rep. of Korea

[21] Appl. No.: 09/099,326

[22] Filed: Jun. 18, 1998

Related U.S. Application Data

[63] Continuation of application No. 08/856,083, May 14, 1997, abandoned.

[30] Foreign Application Priority Data

May 23, 1996 [KR] Rep. of Korea ..... 96-13134 U
Dec. 11, 1996 [KR] Rep. of Korea ..... 96-47852 U

[51] Int. Cl.[6] ..... D06F 37/24

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS 4,060,009 11/1977 Wyman ..... 74/573 R
4,433,592 2/1984 Tatsumi et al. ..... 68/23.2 X
5,724,862 3/1998 Hannah et al. ..... 74/573 R

*Primary Examiner*—Philip R. Coe
*Attorney, Agent, or Firm*—Burns, Doane, Swecker & Mathis, L.L.P.

[57] ABSTRACT

A ball balancer for a washing machine having a rotary tub is provided. The ball balancer comprises an annular casing installed coaxially atop a cylindrical body of the rotary tub and having a radial inner wall and a radial outer wall to form an annular chamber therebetween. Balancing balls and viscous fluid are movably contained in the chamber. An annular reinforcing member is arranged coaxially with the outer wall and is disposed radially inside or outside of that outer wall for reinforcing the outer wall against radially outward forces. The reinforcing member may comprise a cylindrical band attached to the outer wall, or it may be defined by an upper portion of the cylindrical tub body.

7 Claims, 5 Drawing Sheets

REINFORCED BALL BALANCER FOR CLOTHES WASHING MACHINE

This application is a Continuation, of application Ser. No. 08/856,083, filed May 14, 1997, and now abandoned.

BACKGROUND OF THE INVENTION

The present invention relates to a washing machine, and more particularly, to a ball balancer for a washing machine for preventing an unbalanced rotation of a rotary tub generated due to unbalanced laundry in the rotary tub to reduce vibrations and noises.

A conventional washing machine is provided with an outer tub supported by a suspension inside an external cabinet and a rotary tub or spin basket rotatably installed in the outer tub for containing the laundry. The washing machine generally performs washing, rinsing and dehydrating operations according to a controlling program stored in a controller. During the dehydrating operation of laundry contained within the rotary tub, the rotary tub rotates at a high speed so that washing water is dehydrated from the laundry by a rotational force of the rotary tub.

However, an unbalanced load of the laundry within the rotary tub makes the rotary tub rotate in an unbalanced state. Such an unbalanced rotation of the rotary tub is severe, especially at an initial stage of the dehydrating operation and, at this time, vibrations and noises are generated in the outer tub. Thus, a balancer is installed on the rotary tub to prevent the above vibrations and noises. Various balancers are proposed and selected according to the characteristics of the washing machine. U.S. Pat. No. 4,433,592 classifies the types of balancers into a liquid balancer, a solid balancer and a ball balancer.

The ball balancer has a multiplicity of balancing balls serving as a balancing weight and is widely used for a washing machine because of a superior balancing effect compared to the others. FIG. 8 shows a schematic section of a rotary tub 111 provided with a conventional ball balancer 101. As shown in FIG. 8, the conventional ball balancer 101 includes an annular casing 103 having an annular receiving chamber 105 therein, and fixedly installed at the upper portion of the rotary tub 111. The receiving chamber 105 of annular casing 103 is provided with a multiplicity of balancing balls 107 and a viscous fluid 109. The balancing balls 107 made of steel are immersed in the viscous fluid 109. The balancing balls 107 and viscous fluid 109 in the receiving chamber are circumferentially movable within the receiving chamber 105.

The rotation of the rotary tub 111 generates centrifugal force proportional to a square of the rotation speed of the rotary tub. Since the center of the gravity of an unbalanced rotary tub 111 is eccentric relative to the rotation axis thereof, the balancing balls 107 in the receiving chamber 105 move in the receiving chamber 105 opposite to the unbalanced load of the laundry by the action of the centrifugal force while the rotary tub 111 rotates. Accordingly, the balancing balls 107 compensate for the unbalanced load of the laundry to balance the rotary tub 111, so that the vibrations of the rotary tub 111 can be suppressed.

However, in the conventional ball balancer 101 for the washing machine, when the balancing balls 107 within receiving chamber 105 are moved by the centrifugal force toward the opposite side of the unbalanced laundry, a concentrated pressure due to the centrifugal force is applied by the balls on the inner surface of the radial outer wall of the casing 103. Thus, a stress concentration due to the pressure of the balancing balls 107 is generated on the outer wall of the casing 103 which, over a period of time, will cause deformation of the annular casing 103.

Moreover, since the conventional ball balancer 101 is combined with a vertically short upper portion of the upper circumference of the rotary tub 111, the radial force of the balancing balls 107, i.e., the strong pressure applied to the radial outer wall of the casing 103, is transmitted to that short upper portion of the rotary tub 111, to thereby cause deformation to the upper portion of the rotary tub 111 where the ball balancer 101 is installed. Particularly, in case that the rotation speed of the rotary tub 111 is increased to enhance the dehydrating efficiency, the upper portion of the rotary tub 111 may be damaged by the centrifugal force which increases in proportion to a square of the rotation speed. In this case, the balancing balls 107 may break away causing the viscous fluid 109 to flow out from the ball balancer 101, so that the ball balancer 101 does not perform its balancing function stably, thereby generating vibrations and noises to the rotary tub 111.

SUMMARY OF THE INVENTION

It is an object of the present invention to provide a ball balancer for a washing machine the structure of which is improved to resist deformation which may be generated due to the rotational pressure of balancing balls and to increase the endurance of the ball balancer.

Another object of the present invention is to provide a ball balancer for a washing machine for preventing deformation of a rotary tub.

To accomplish the above objects, there is provided a ball balancer for a washing machine having a rotary tub, comprising:

- an annular casing installed coaxially atop the rotary tub and having an radial inner wall and an radial outer wall to form an annular receiving chamber formed therebetween;
- a multiplicity of balancing balls movably contained in the chamber of said casing;
- a viscous fluid contained in the chamber of the casing; and
- an annular reinforcing member disposed adjacent to the outer wall of the casing for reinforcing the radial outer wall of the casing against a centrifugal force of the balancing balls and the viscous fluid due to the rotation of the rotary tub.

Preferably, the reinforcing member is disposed on an outer surface of the outer wall of the casing. In this case, the reinforcing member may be integrally formed with the rotary tub.

Alternatively, the reinforcing member may be disposed on an inner surface of the outer wall of the casing.

According to another aspect of the present invention, the casing has a plurality of the annular receiving chambers disposed coaxially to each other, and each of annular receiving chambers is associated with a reinforcing member.

BRIEF DESCRIPTION OF THE DRAWINGS

The above objects and advantages of the present invention will become apparent by describing in detail preferred embodiments thereof with reference to the accompanying drawings in which.

DETAILED DESCRIPTION OF PREFERRED EMBODIMENTS OF THE INVENTION

Figure 1:
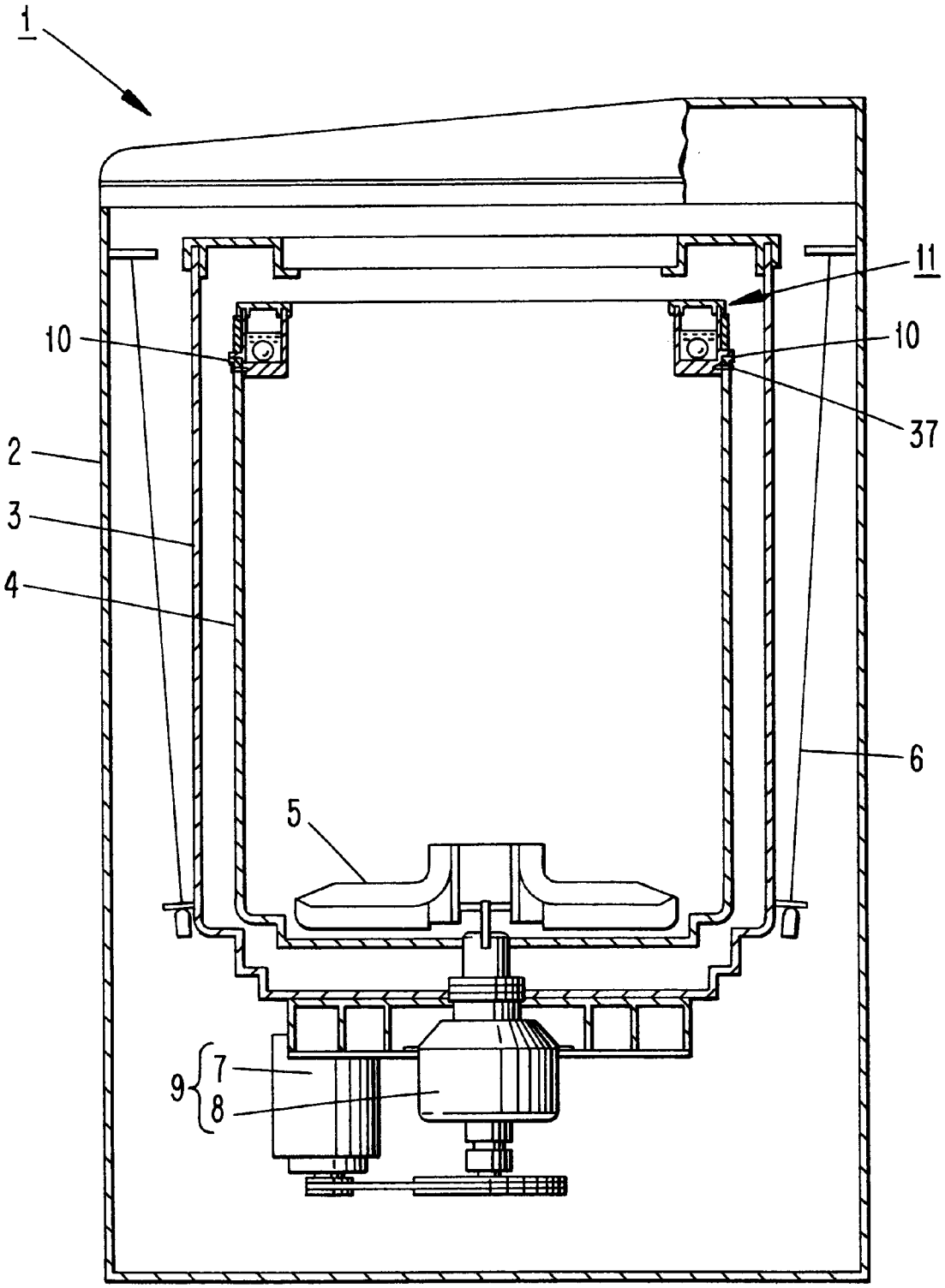
FIG. 1 shows a vertical cross section of a washing machine provided with a ball balancer according to a first embodiment of the present invention.

Referring to FIG. 1, a washing machine 1 in which an annular ball balancer 11 according to a first embodiment of the present invention is mounted, includes an external cabinet 2, an outer tub 3 supported by a suspension 6 inside the external cabinet 2 and a rotary tub or spin basket 4 rotatably installed in the outer tub 3. The external cabinet 2 has an approximately rectangular cylinder shape. The outer tub 3 for containing washing water and the rotary tub 4 for containing the laundry have a circular cylinder shape, respectively. A multiplicity of holes are formed through the wall of the rotary tub 4 for communication of the washing water with the outer tub 4. A pulsator 5 for forming a spiral flow of the washing water is provided at the bottom of the rotary tub 4.

A power transmission unit 9 including a driving motor 7 and a shaft assembly 8 is installed below the outer tub 3. The power transmission unit 9 is combined to the lower portion of the outer tub 3 while being surrounded by a saddle (not shown), and selectively rotates the rotary tub 4 or the pulsator 5 in a forward or reverse direction according to a program stored in a controller (not shown). Accordingly, the laundry within the rotary tub 4 is sequentially washed, rinsed and dehydrated.

Referring to FIG. 1, a flange 10 (better shown in FIGS. 5 and 6) protrudes radially outward from the upper circumference of the rotary tub 4. The flange 10 supports the ball balancer 11 by contact with a supporting rib 23 (to be described later in connection with FIG. 2) formed at the lower portion of the annular ball balancer 11.

Figure 2:
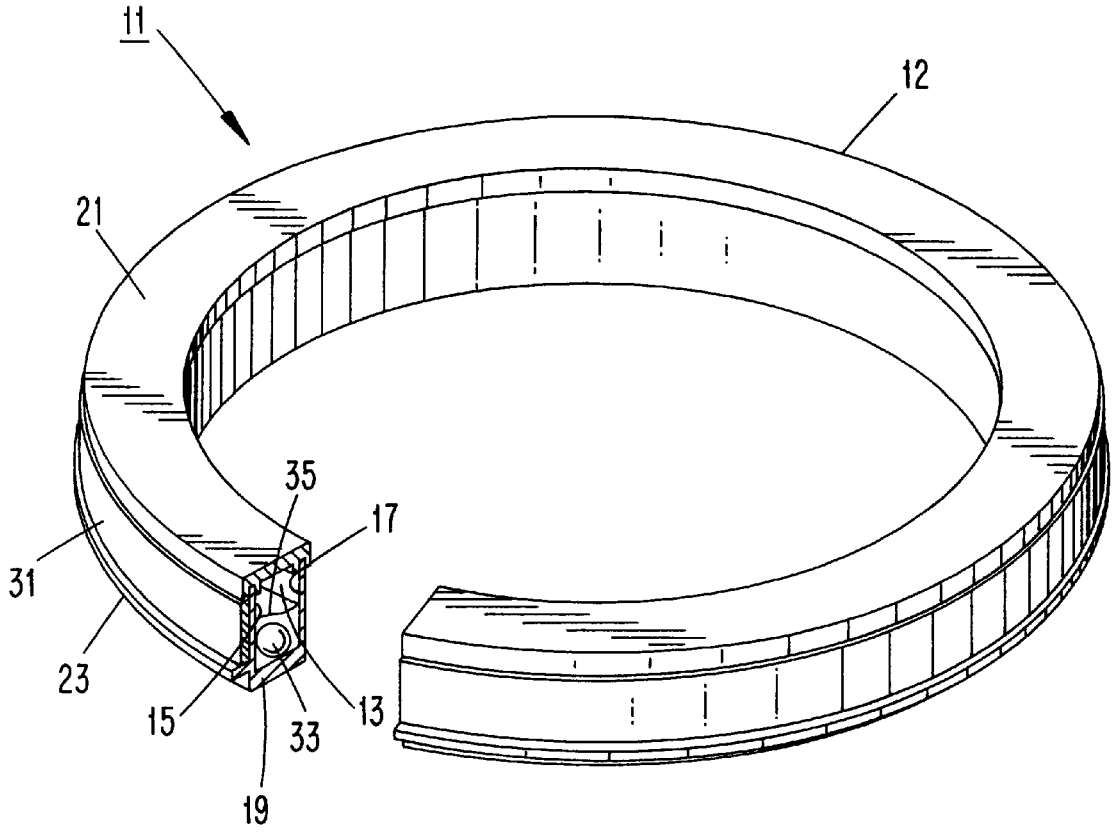
FIG. 2 is a perspective view of the ball balancer in FIG. 1.
Figure 3:
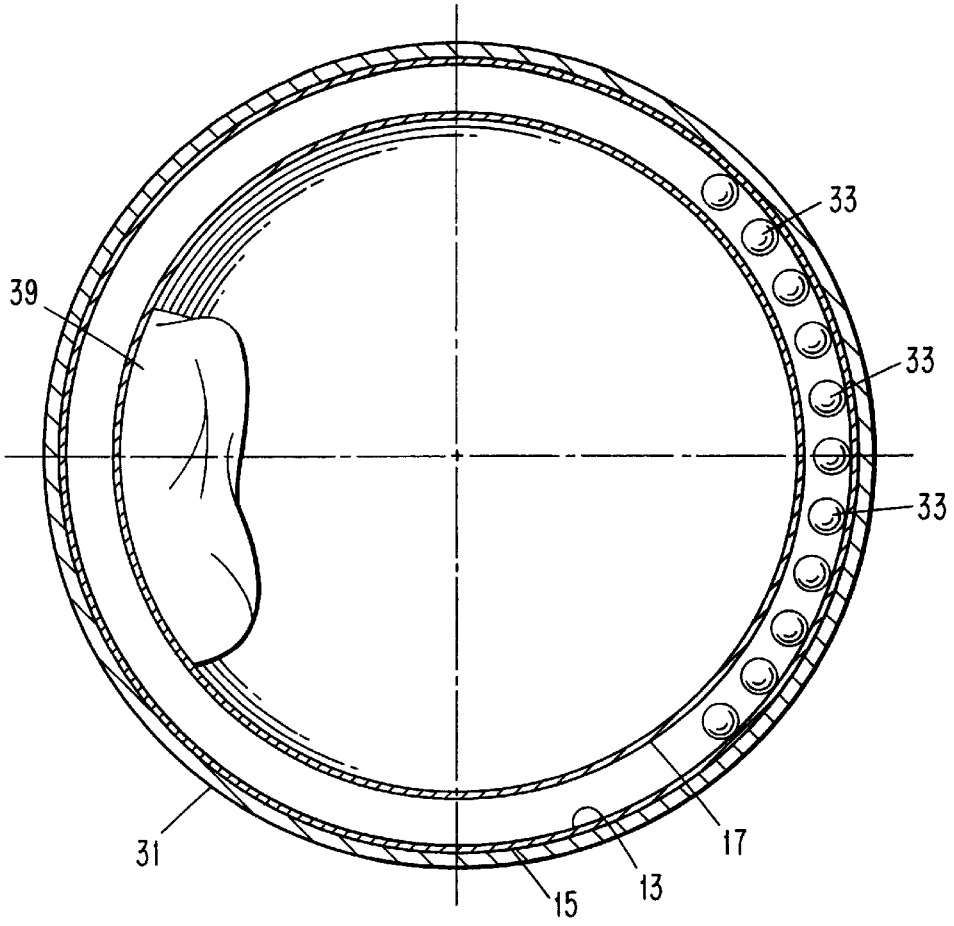
FIG. 3 shows a horizontal cross section of the ball balancer in FIG. 2.

As shown in FIGS. 2 and 3, the ball balancer 11 has an annular casing 12 installed at the upper portion of the rotary tub 4 coaxially therewith and forms an annular receiving chamber 13. The casing 12 includes a radially inner wall member 17, a radially outer wall member 15 and a bottom member 19, which are integrally interconnected. The casing 12 further includes a covering member 21 for covering the annular receiving chamber 13 formed by the inner and outer wall members 17 and the bottom member 19.

The chamber 13 formed in the casing 12 contains a multiplicity of balancing balls 33 and a viscous fluid 35. The balancing balls 33 and the viscous fluid 35 can move along the chamber 13. The balancing balls 33 and the viscous fluid 35 can be easily inserted into the chamber 13 while the covering member 21 is opened.

The supporting rib 23 protrudes radially outward from the lower circumference of the outer wall 15 of the casing 12. The supporting rib 23 is correspondingly disposed on the flange 10 formed on the upper circumference of the rotary tub 4. The bottom member 19 of the casing 12 and the upper portion of the rotary tub 4 are integrally combined with each other by a fastening member such as a screw 37. Thus, the casing 12 can be fixedly disposed inside the upper portion of the rotary tub 4.

Figure 4:
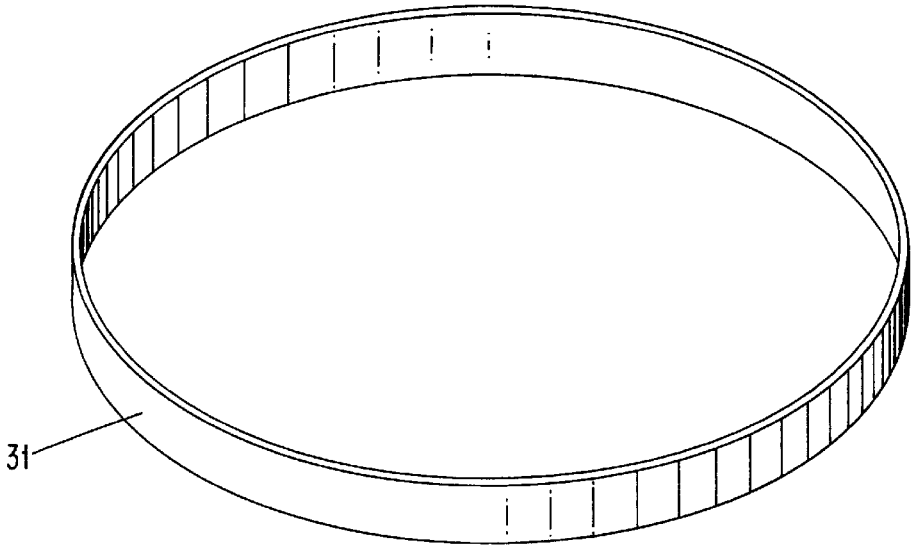
FIG. 4 is a perspective view of a reinforcing member used in the ball balancer according to the first embodiment of the present invention.

Referring to FIGS. 2, 3 and 4, the casing 12 also includes an annular reinforcing member or band 31 installed to contact the outer surface of the outer wall 15 while the lower end of the reinforcing member 31 is supported on the supporting rib 23. The reinforcing member 31 has such a thickness that deformation of the casing 12 due to the centrifugal force of the balancing balls 33 and the viscous fluid 35 can be prevented, and is preferably made of metal such as aluminum or steel which has a superior impact stress. The reinforcing member 31 functions to reinforce the outer wall 15 of the casing 12 against the centrifugal force of the balancing balls 33 and the viscous fluid 35 generated due to the rotation of the rotary tub 4.

According to the ball balancer 11 having the above-described structure, during the washing or rinsing operation i.e., when the rotary tub 4 hardly rotates or rotates at a speed lower than the resonant rotation rate, each balancing balls 33 rotate integrally with the rotary tub for a short period of time due to the viscosity of the viscous fluid. And, as the rotary tub 4 increases its speed gradually, each balancing ball 33 moves freely within the annular receiving chamber 13. On the other hand, during the dehydrating operation when the rotary tub 4 rotates at a high speed greater than the resonant rotation rate, the balancing balls 33 move to a location opposite to the load of the laundry 39, to thereby balance the rotation of the rotary tub 4.

In this case, the centrifugal force of the balancing balls 33 and the viscous fluid 35 due to the rotation of the rotary tub 4 and unbalanced laundry load is applied to the outer wall 15 of the casing. However, in this embodiment, since the reinforcing member 31 reinforces the outer wall 15 against the centrifugal force, deformation or damage of the outer wall 15 and the upper portion of the rotary tub 4 can be prevented.

Hereinafter, ball balancers according to modified embodiments of the present invention will be described with reference to FIGS. 5, 6 and 7. Here, like numerals designate like elements, in FIGS. 1 to 3.

Figure 5:
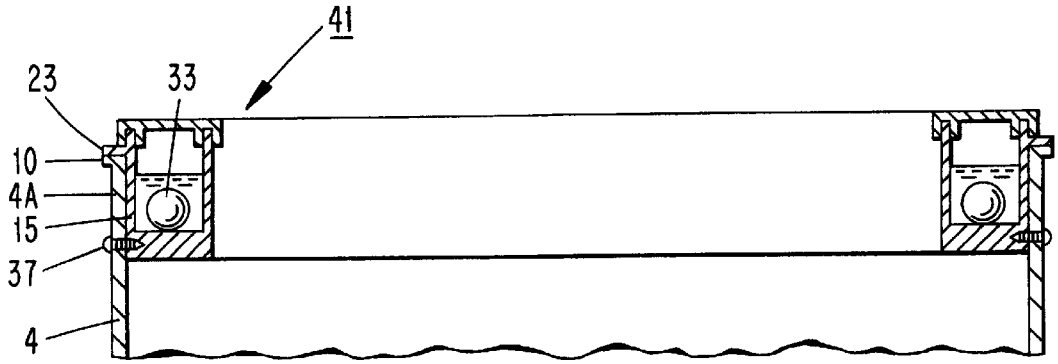
FIG. 5 is a vertical cross sectional view of a ball balancer according to a second embodiment of the present invention.

Referring to FIG. 5, a ball balancer 41 according to a second embodiment of the present invention includes the same elements as in FIGS. 1 to 3. However, a supporting rib 23A is formed at the upper (not lower) portion of the outer wall 15 and the upper end portion 4A of the rotary tub 4 on which the flange 10 is formed is extended upwardly to the lower surface of the supporting rib 23A of the outer wall 15. The upper end portion of the rotary tub 4 and the outer wall 15 of the casing 12 are combined with each other by the screws 37 so that the upper surface of the flange 10 of the rotary tub 4 contacts the lower surface of the supporting rib 23. According to this structure, the reinforcing member 31 of the first embodiment is replaced by the extended upper portion 4A of the rotary tub 4 to reinforce the outer wall 15 of the ball balancer 41 and the upper portion of the rotary tub 4.

Figure 6:
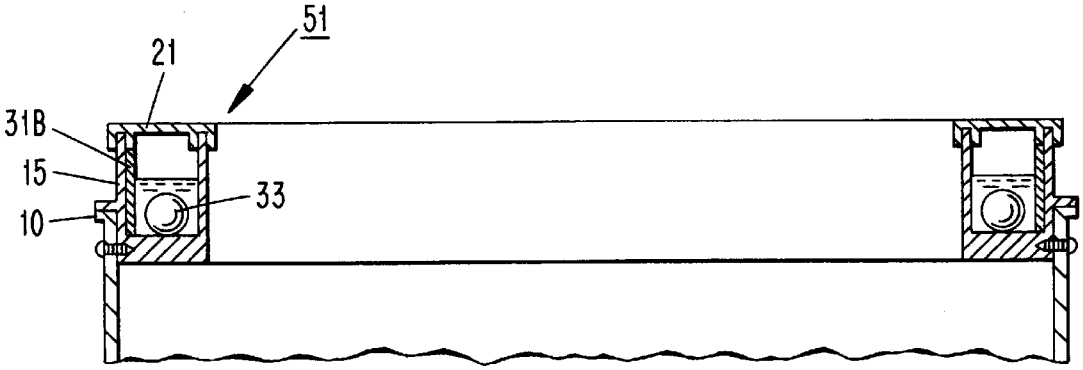
FIG. 6 is a vertical cross sectional view of a ball balancer according to a third embodiment of the present invention.

Referring to FIG. 6, a ball balancer 51 according to a third embodiment of the present invention has the same elements as in the first embodiment, but a reinforcing member or annular band 31B is located radially inside the outer wall 15 of the casing 12. The reinforcing member 31B can be easily inserted inside the outer wall 15 when the covering member 21 is removed from the casing 12.

Figure 7:
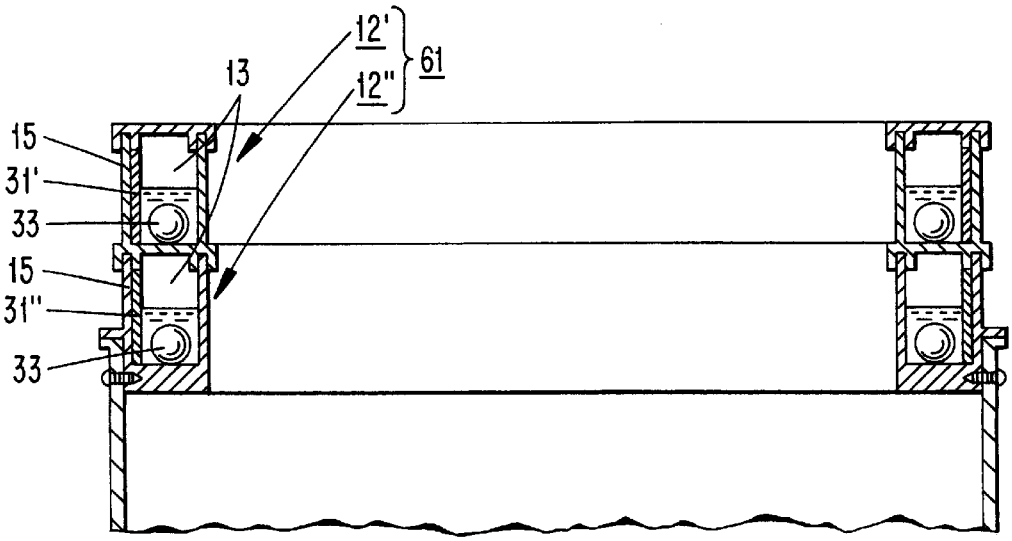
FIG. 7 is a vertical cross sectional view of a ball balancer according to a fourth embodiment of the present invention.
Figure 8:
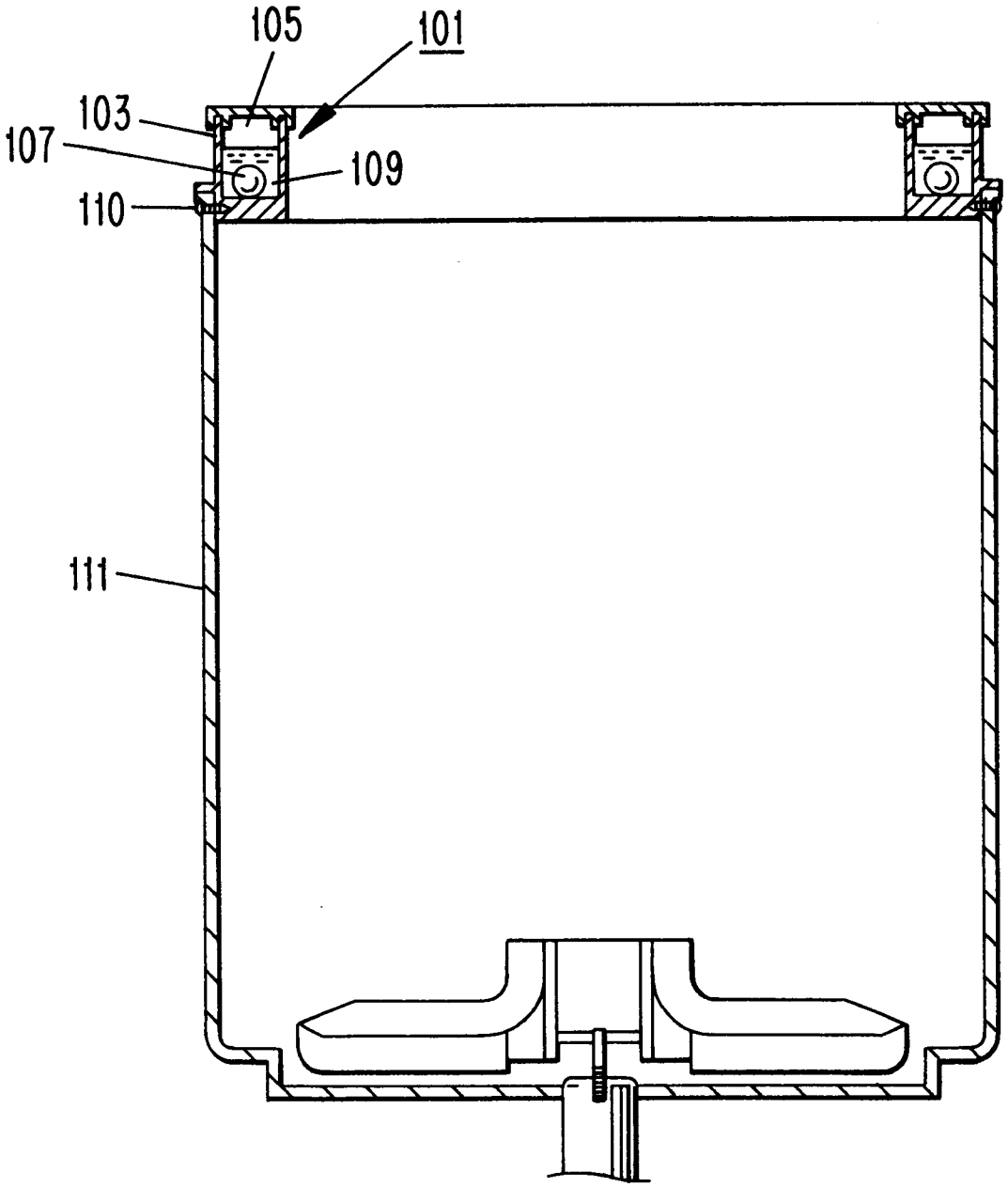
FIG. 8 (PRIOR ART)
FIG. 8 shows a vertical cross section of a washing machine provided with a conventional ball balancer.

Referring to FIG. 7, a ball balancer 61 according to a fourth embodiment of the present invention includes a pair of casings 12', 12" having approximately identical structures and concentrically combined with each other vertically, that is, one upon the other. The balancing balls 33 and the viscous fluid 35 are contained in the respective chambers 13 of the pair of casings 12', 12" to maintain the rotational balance of the rotary tub 4. A pair of reinforcing members 31', 31" are located radially inside the outer walls 15 of the respective casings 12. According to the ball balancer 61 having the above-described structure, since the rotational radii of the respective casings 12 are different from each other (i.e., since radial distances from the axis of rotation to the respective casings are different) at the time of the unbalanced rotation of the rotary tub 4, the upper balancing balls 33 move independently of the lower balancing balls. That is, the upper and lower balancing balls 33 move independently according to the unbalanced load of the laundry 39 and the rotation speed of the rotary tub 4, so that the rotational balance of the rotary tub 4 can be maintained more effectively. The respective reinforcing members 31 prevent deformation and damage of the casings 12 and the rotary tub 4 due to the centrifugal force of the balancing balls 33 and the viscous fluid 35 during the rotation of the rotary tub 4.

Although the pair of casings 12 are arranged vertically in the fourth embodiment, the casings 12 may be arranged horizontally, that is, laterally, and the respective reinforcing members 31 would preferably be located inside the outer walls 15 of the respective casings 12.

Further, more than two casings 12 having approximately identical structures can be installed vertically or horizontally, according to the characteristics and capacity of the washing machine.

Although separately-manufactured reinforcing members 31 are used in the first, third and fourth embodiments, the reinforcing members 31 can be integrally extruded with the casings 12 during fabrication thereof.

As described above, according to a ball balancer for a washing machine of the present invention, a reinforcing member is installed adjacent to a radially outer wall of a casing in which balancing balls and a viscous fluid are contained, so that the casing and a rotary tub are prevented from deformation and damage which can be generated due to the centrifugal force of the balancing balls and viscous fluid during rotation of the rotary tub. Therefore, the endurance of the casing and the rotary tub is improved so that the ball balancer can perform its balancing function stably while preventing vibrations and noises, regardless of the lapse of time.

What is claimed is:

1. A rotary tub adapted for use in a washing machine, comprising:

an upwardly open cylindrical body;

a ball balancer for balancing the body, including:

an annular casing mounted atop the body, the casing including a cylindrical radially inner wall, and a cylindrical radially outer wall spaced radially outwardly from the inner wall to form a chamber therebetween, balancing balls and viscous fluid movably disposed in the chamber, and an annular reinforcing member arranged coaxially with the outer wall and extending along at least a substantial portion of a height of the chamber for reinforcing the outer wall against radially outward forces.

2. The rotary tub according to claim 1 wherein the reinforcing member comprises a cylindrical band.

3. The rotary tub according to claim 1 wherein the reinforcing member is disposed around an outer surface of the outer wall.

4. The rotary tub according to claim 3 wherein the reinforcing member is defined by an upper portion of the tub, the upper portion extending along a substantial portion of a height of the outer wall.

5. The rotary tub according to claim 1 wherein the reinforcing member is disposed around an inner surface of the outer wall.

6. The rotary tub according to claim 1 wherein the annular casing and annular reinforcing member constitute a first casing and a first reinforcing member, respectively, and further including at least one additional annular casing arranged coaxially with respect to the first casing and containing balancing balls and viscous fluid, the at least one additional casing having a second annular reinforcing member arranged coaxially against its outer wall.

7. A clothes washing machine, comprising:

a cabinet;

an outer tub suspended within the cabinet;

an inner tub rotatably mounted in the outer tub and including holes formed therethrough, the inner tub including an upwardly open body;

an agitator disposed in the inner tub for agitating clothes during a washing cycle; and a ball balancer for balancing the body, including:

an annular casing mounted atop the body, the casing including a cylindrical radially inner wall, and a cylindrical radially outer wall spaced radially outwardly from the inner wall to form a chamber therebetween, balancing balls and viscous fluid movably disposed in the chamber, and an annular reinforcing member arranged coaxially with the outer wall and extending along at least a substantial portion of a height of the chamber for reinforcing the outer wall against radially outward forces.

* * * * *